US011293245B2

(12) United States Patent
Stewart et al.

(10) Patent No.: US 11,293,245 B2
(45) Date of Patent: Apr. 5, 2022

(54) DEPLOYMENT OF DOWNHOLE SENSING DEVICES

(71) Applicant: Globaltech Corporation Pty Ltd, Forrestfield (AU)

(72) Inventors: Gordon Stewart, Forrestfield (AU); Raymond Hill, Kingsley (AU)

(73) Assignee: Globaltech Corporation Pty Ltd, Forrestfield (AU)

( * ) Notice: Subject to any disclaimer, the term of this patent is extended or adjusted under 35 U.S.C. 154(b) by 424 days.

(21) Appl. No.: 15/747,441

(22) PCT Filed: Jul. 29, 2016

(86) PCT No.: PCT/AU2016/050680

§ 371 (c)(1),
(2) Date: Jan. 25, 2018

(87) PCT Pub. No.: WO2017/015719

PCT Pub. Date: Feb. 2, 2017

(65) Prior Publication Data

US 2018/0216430 A1 Aug. 2, 2018

(30) Foreign Application Priority Data

Jul. 29, 2015 (AU) ..... 2015903018
Aug. 19, 2015 (AU) ..... 2015903365

(51) Int. Cl.

| | |
|---|---|
| ***E21B 23/08*** | (2006.01) |
| ***E21B 21/10*** | (2006.01) |
| ***E21B 47/024*** | (2006.01) |
| ***E21B 23/02*** | (2006.01) |
| ***E21B 23/01*** | (2006.01) |
| ***E21B 33/12*** | (2006.01) |

(Continued)

(52) U.S. Cl.
CPC ..... *E21B 23/08* (2013.01); *E21B 21/10* (2013.01); *E21B 23/01* (2013.01); *E21B 23/02* (2013.01);

(Continued)

(58) Field of Classification Search
CPC ..... E21B 23/01; E21B 23/04; E21B 23/08; E21B 23/10; E21B 34/08; E21B 34/10;

(Continued)

(56) References Cited

U.S. PATENT DOCUMENTS 4,109,521 A * 8/1978 Youmans ..... E21B 23/14 73/152.17
6,209,391 B1 * 4/2001 Dallas ..... E21B 47/017 73/152.46

(Continued)

OTHER PUBLICATIONS

International Search Report for PCT Application PCT/AU2016/050680 dated Oct. 24, 2016.

*Primary Examiner* — Tara Schimpf
(74) *Attorney, Agent, or Firm* — Charles H. Jew

(57) ABSTRACT

A downhole sensing device deployment control apparatus (10) includes means to control speed of the sensing device progressing within a borehole associated with a drilling operation. A mechanical, electrically powered and/or hydrodynamic drag/damping means/device (12) can be provided as part of the control apparatus to control speed of deployment down the borehole. The drag device (12) can have a plurality of wheels or rollers to contact an internal bore of an inner pipe of a drill string. Rotation control means (24), (26) can be provided to control an amount of rotation and/or direction of rotation of the wheels or rollers relative to travel of the sensing device within the borehole. Valving (60) can be provided. A two stage (dual) flow/pressure control valve (100) can be provided. A sensing device (release 216) and downhole position latch (202) can be provided. The sensing device can be pumped into the borehole, such as by compressed air.

31 Claims, 5 Drawing Sheets

(51) Int. Cl.
*E21B 34/08* (2006.01)
*E21B 23/00* (2006.01)
*E21B 1/00* (2006.01)

(52) U.S. Cl.
CPC ..... *E21B 33/12* (2013.01); *E21B 34/08* (2013.01); *E21B 47/024* (2013.01); *E21B 1/00* (2013.01); *E21B 23/001* (2020.05); *E21B 2200/05* (2020.05)

(58) Field of Classification Search
CPC ..... E21B 34/101; E21B 34/105; E21B 31/00; E21B 47/00
See application file for complete search history.

(56) References Cited

U.S. PATENT DOCUMENTS

| | | | | |
|---|---|---|---|---|
| 6,360,823 | B1 * | 3/2002 | Ranson | E21B 23/00 166/381 |
| 6,910,537 | B2 | 6/2005 | Brown | |
| 8,650,694 | B2 * | 2/2014 | Pruett | B08B 9/0557 15/104.061 |
| 9,470,073 | B2 * | 10/2016 | Xiao | E21B 43/121 |
| 2008/0156531 | A1 | 7/2008 | Boone | |
| 2014/0054030 | A1 * | 2/2014 | Hetz | E21B 47/16 166/250.17 |
| 2014/0196953 | A1 | 7/2014 | Chitwood | |

* cited by examiner

DEPLOYMENT OF DOWNHOLE SENSING DEVICES

FIELD OF THE INVENTION

The present invention relates to deployment of one or more downhole sensing devices, such as sensing devices and logging instruments, one or more gamma detector(s), gyroscope(s), accelerometer(s), pressure sensor(s), temperature sensor(s), vibration sensor(s), camera(s) and magnetometer(s), or combinations of two or more thereof, within a borehole associated with a drilling operation.

The present invention finds particular application to, though not solely to, onshore 'hard rock' drilling and survey operations relating to subsurface formations.

The present invention finds particular application in relation to, though not solely to, reverse circulation (RC) drilling operations.

BACKGROUND TO THE INVENTION

A downhole sensing device can include any downhole sensing device, such as one or more gamma detector(s), gyroscope(s), accelerometer(s), pressure sensor(s), temperature sensor(s), vibration sensor(s), camera(s) and magnetometer(s), or combinations of two or more thereof. The sensing device may include a sensing device, a logging instrument, or a combination of both.

A downhole survey is conducted once a borehole is drilled. Depending on the ore type being sought, a downhole survey will measure one or more of the hole azimuth and inclination, passive or active gamma radiation, magnetic susceptibility, and other parameters. These parameters are 'logged' by the sensing device e.g. parameters are detected and values/data recorded by the sensing devices and brought to the surface for analysis and reporting.

As a means of reducing cost and improving efficiency it has previously been proposed that logging take place while drilling, by fitting a sensing device down the hole whilst the drilling is taking place. This is generally called 'Logging-While-Drilling' (LWD) or 'Measure-While-Drilling' (MWD). LWD or MWD is difficult in the case of 'Down-the Hole' (DTH) drilling as there are very high vibration levels due to the percussion action of the hammer. Typically DTH drilling uses what is essentially a mini percussion at the end of the drill string to effect drilling which necessarily generates significant vibration through the drill string and drilling has to cease before survey parameters can be accurately detected while there is no vibration.

As an alternative to LWD or MWD, it has been proposed that a sensing device be delivered to the bottom of the hole inside the inner pipe when RC drilling, and an automatic log recorded by the sensing device (survey instrument) while the drill rods are removed from the hole. In this manner the sensing device will be moved progressively from the bottom to the top of the hole in a controlled manner as the drill bit and sensing device are extracted to the surface. This eliminates the waiting time for a separate survey crew to arrive and carry out the log. It does require the drill crew to however remove the rods slower than would be normal practice, in order to give the sensing device time to acquire sufficient data during its return trip to the surface.

The simplest method to deploy the sensing device would be to connect it to a winch/wireline and lower it in the same manner as is conducted with a down the hole camera.

However, in the interests of safety, some mining operators prevent the use of such winches on RC rigs and therefore winch/wireline deployment is not allowed.

In practice, the wireline would need to be disconnected from the sensing device and withdrawn from the hole once the instrument was in place, as one cannot extract the drill string from the hole and remove discrete pipes whilst a wire cable is present within the pipes.

The RC drilling process comprises use of a modified rotary percussion hammer to drill a hole through a formation, the purpose of which is to pneumatically convey to the surface the cuttings thus created, separate them from the air in a cyclone, and collect the cuttings at intervals (typically 1 metre intervals) into bags. At a later stage the samples are sent to an assay lab for analysis to determine the minerals present.

The most recent incarnation of the hammer involves collection of the cuttings at the face of the bit, from whence they are conveyed to the centre of the bit, and subsequently travel up the centre of the hammer drill through a sample tube.

Unlike conventional DTH drilling, the RC method utilises dual wall drill pipe whereby the high pressure air required to power the hammer travels down the annulus between the inner and outer pipes, whilst the exhaust air from the hammer motor flushes the cuttings from the bit face and subsequently conveys them to the surface via the inside of the inner pipe. A smaller portion of the exhaust air also travels up the cavity formed between the outside of the drill string and the bore of the hole being drilled. This is required in order to keep the hole clean, prevent the string from becoming stuck, and to keep out ground water so that a dry sample is delivered to the surface.

On completion of the drilling of an RC drilling operation borehole it is necessary to survey the borehole. This is normally done immediately as otherwise with time the borehole will often collapse inwards. Should such collapse happen, it is necessary to re-locate the drill rig on the drill pad and re-drill the borehole. There are two approaches taken in order to eliminate the need to re-drill the borehole:

- Firstly a survey crew and vehicle will be on-site, especially if the drilling is brown-fields and there are a number of rigs operating in the same area. Once the borehole is completed, the drill rig will remain at the borehole with the drill string down the hole and will wait until the survey crew arrives. The survey probe is then calibrated and lowered down the RC drill string on a winch. Depth is measured as the survey probe advances down the borehole. As a guide, for, say, a 300 metre hole the survey will require approximately 3 hours to complete. The drill rig crew during this period will do odd jobs on the rig such as cleaning, filling up water, fuel etc. Often the drill rig crew will have to wait an hour or so prior to the survey crew arriving. As a result, 3~4 hours of lost drill rig operating time arises, severely impacting its productivity. The financial cost through lost utilisation of rig crew while the rig is at standby, and the financial cost through lost utilisation of the survey crew before the borehole is ready for surveying, is significant.
- The second approach if the drilling is remote and insufficient drill rigs are operating to justify having a survey crew on-hand, is to remove the drill string from the borehole, and to then insert a PVC liner, typically 500 mm in diameter, the full depth of the borehole. This thereby provides a smooth conduit in which to deploy the survey equipment at a later date, this being conducted when there are multiple boreholes waiting to the surveyed as a block.

With one or more of the aforementioned problems in mind, it is desirable to provide a device, system and/or method for downhole sensing device deployment into a borehole, and preferably within a borehole within the RC drill string, without connection of the sensing device to the surface.

It is further desirable to provide a device, system and/or method for rapid descent deployment of a sensing device associated with a reverse circulation (RC) drilling operation.

It is yet further desirable to provide a device, system and/or method for gravity deployment or pressure assisted deployment of a sensing device without having physical connection of the sensing device to a deployment and recovery means at the surface, such as a wireline or drill pipe arrangement.

SUMMARY OF THE INVENTION

With the aforementioned in view, an aspect of the present invention provides a downhole sensing device deployment control apparatus, including means to control speed of the sensing device progressing within a borehole associated with a drilling operation.

The sensing device need not be attached to a wireline or form part of a drill string or pipe arrangement during downward deployment within the borehole.

The control apparatus may be attached to the sensing device i.e. the two devices connected together, or may be an integral part of the sensing device i.e. a single unit.

A drag device may be provided. For example, a mechanical mechanism, an electrically powered means and/or a hydro-dynamic drag/damping means may be provided as part of the control apparatus to control speed of deployment down the borehole.

The drag device may, for example, include a plurality of wheels or rollers arranged to contact an internal bore of an inner pipe of a drill string, the plurality of wheels or rollers including sensing device descent control arrangement.

A rotation control means may be provided to control an amount of rotation and/or direction of rotation of the wheels or rollers relative to travel of the sensing device within the borehole.

The rotation control means may include one or more of the wheels or rollers having a direction of rotation unaligned with an axial extent of the borehole. For example, one or more of the wheels/rollers may be skewed from alignment along the bore so that each such wheel/roller rotates about its respective axis of rotation that is not normal to the axis of the borehole.

Therefore, the one or more of the wheels or rollers may have a direction of rotation unaligned with an axial extent of the borehole coupled to a rotational component of the control apparatus such that, as the control apparatus progresses towards a terminal end of the borehole, rotation of the unaligned one or more wheels or rollers cause(s) the rotational component to rotate about an axis coaxial with the borehole.

The rotational component may be coupled by a shaft to a damper device. Preferably the damper device may have a viscous coupling, which may incorporate a plurality of vanes.

The plurality of vanes of the damper device may include first and second internal vanes within a damping liquid, and relative motion of the first and second vanes with respect to one another can damped by the liquid.

The viscous coupling may be associated with a second component of the control apparatus, the second component including one or more other of said wheels or rollers arranged for rotation inline with the direction of the borehole.

Alternatively, the other wheel(s) or roller(s) of the second component may be skewed in an opposite direction to those of the first component, such that during downhole descent, the first and second components rotate in opposite directions with respect to one another. Therefore, the viscous damping effect is increased or reduced size/number of vanes may be provided.

At least one external seal may be provided on the control apparatus and/or sensing device arranged to seal against an internal pipe bore within the borehole, such as the internal bore of the inner pipe within which the apparatus and sensing device travel.

The at least one external seal may include at least one aperture, preferably having an aperture area independent of a pipe bore diameter within the borehole.

Adjustment means may be provided to adjust the aperture area in order to adjust speed of the sensing device travelling within the borehole.

A further aspect of the present invention provides a sensing device deployment control device or control system, the device or system including the sensing device deployment control apparatus and a downhole sensing device.

At least one blow down sub and/or head valve may be provided to control pressure in the borehole, preferably within the inner pipe.

Pressure control means may be provided to maintain positive pressure within a bore of an inner pipe to prevent entry of water into the bore of the inner pipe.

A landing device may be provided at a landing location within the inner pipe to prevent impact damage to the sensing device.

Retaining means to ensure correct positioning of the sensing device within the borehole.

Preferably the retaining means includes latching means including at least one link or at least one cam, or a combination of at least one link and at least one cam.

The retaining means may include at least one shoulder outwardly disposed away from flow within the inner pipe.

A sub may be provided between a lead rod and a next uphole rod, with preferably the sub including the at least one shoulder.

A retrieval means may be provided to recover the deployed sensing device from downhole. The retrieval means may include a wireline and winch arrangement e.g. associated with the drill rig.

At least one one-way valve may be provided downhole prior to deployment of the sensing device. The at least one one-way valve may allow water to be expelled from the inner pipe and prevent water entering the inner pipe.

The at least one one-way valve may be propelled downhole in advance of the sensing device being deployed.

A landing device may be provided to receive and dampen impact of the at least one one-way valve at a required downhole position.

A one way valve retaining device may be provided to retain the at least one one-way valve in a required position downhole.

Inner pipe purge means may be provided to pressurise the inner pipe and expel water therefrom prior to deploying the sensing device.

The system may include a one way flow control means to allow water to backflow when the sensing device has been deployed and retained in its working position.

A further aspect of the present invention provides a method of blocking or plugging a bottom end of a borehole includes operating a percussion or hammer type drill downhole without rotation of the drill.

The method preferably including creating chippings at the bottom of the borehole ahead of the percussion or hammer type drill by operating the percussion or hammer type drill without rotation, the chippings aiding plugging of the borehole.

A further aspect of the present invention provides means for loading and holding a sensing device within the drill string prior to purging air or water or both air and water.

A further aspect of the present invention provides means for deploying the sensing device without depressurisation of the inner pipe.

A further aspect of the present invention provides means for releasing a sensing device for deployment into a drill pipe once the drill pipe is purged of unwanted water, the means including at least one latch device that is/are released to allow the sensing device to advance into the drill pipe.

A yet further aspect of the present invention provides a method of determining when to release the sensing device from a sub.

A still further aspect of the present invention provides means for controlling the descent speed via air flow/pressure at the top of the borehole.

Another aspect of the present invention provides means for determining when the sensing device is in place downhole.

The downhole sensing device may include one or more downhole sensing devices, such as sensing devices and logging instruments, one or more gamma detector(s), gyroscope(s), accelerometer(s), pressure sensor(s), temperature sensor(s), vibration sensor(s), camera(s) and magnetometer (s), or combinations of two or more thereof, within a borehole associated with a drilling operation.

It will be appreciated that one or more forms of the present invention facilitate deployment of a sensing device along a borehole without physical connection of the sensing device to the surface (such as being part of a drill string or on a wireline). Such deployment posed a number of challenges:

- Inclination angle of the borehole can vary typically from 55 degrees to vertical down. Inclination angle is the deviation angle (typically measure din degrees) from vertically down i.e. vertical equates to 0 degrees inclination.
- There may be water present at times in the hole and the inner drill pipe.
- The inner pipe diameter, through which the sensing device will travel, is variable e.g. due to abrasive wear inside the inner pipe. The diameter can be, for example, 5 mm larger in diameter on the lead inner rod than for a less worn mid or top of the string pipe.
- The sensing device contains fragile electronic components and sensors and must not impact the bottom of the borehole at excessive speed or otherwise risk damage to the expensive sensing device and time lost in withdrawing and replacing the sensing device.
- Damage may occur to the body of the sensing device or the hammer top end components if the speed is excessive.

BRIEF DESCRIPTION OF THE DRAWINGS

One or more embodiments of the present invention will hereinafter be described with reference to the drawings, in which.

DESCRIPTION OF PREFERRED EMBODIMENT(S)

Figure 1:
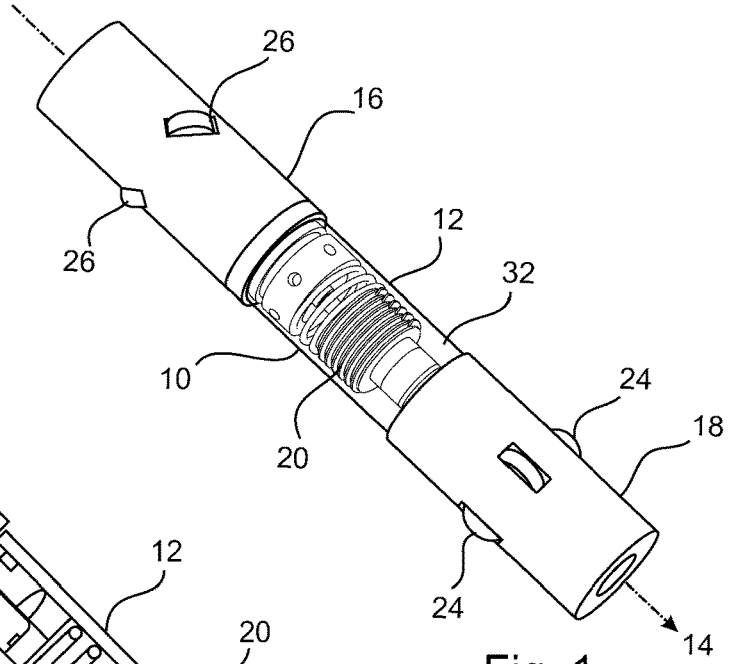
FIG. 1 shows a sensing device deployment control apparatus according to an embodiment of the present invention.
Figure 2:
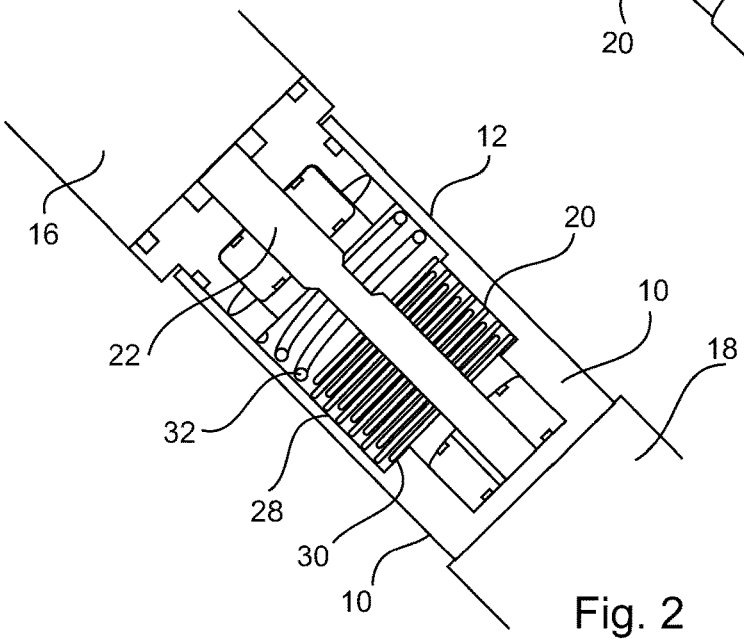
FIG. 2 shows an interior sectional view of a drag device forming part of the sensing device deployment control apparatus of FIG. 1.
Figure 3:
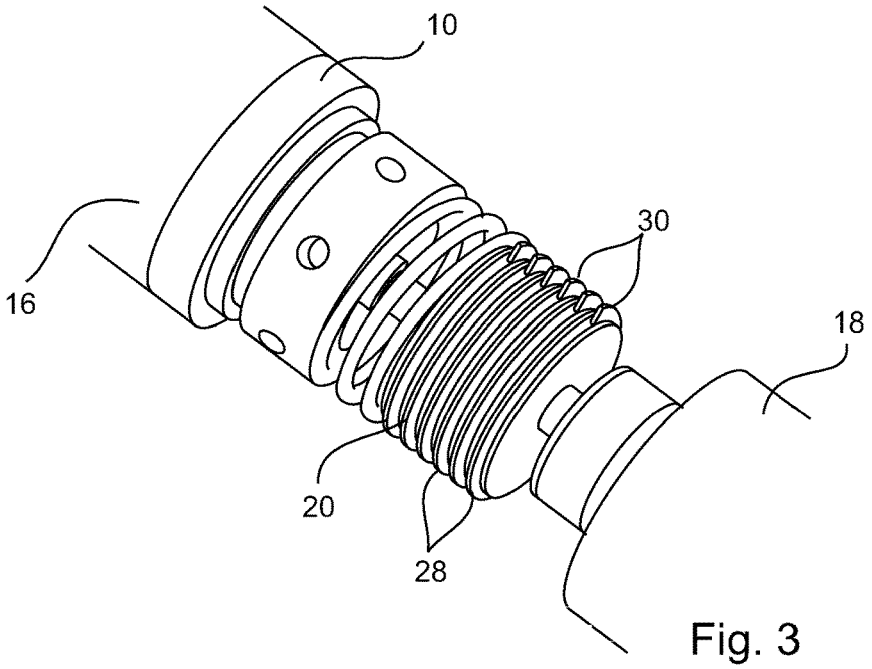
FIG. 3 shows detail of the drag device of the sensing device deployment control apparatus of FIGS. 1 and 2.
Figure 4:
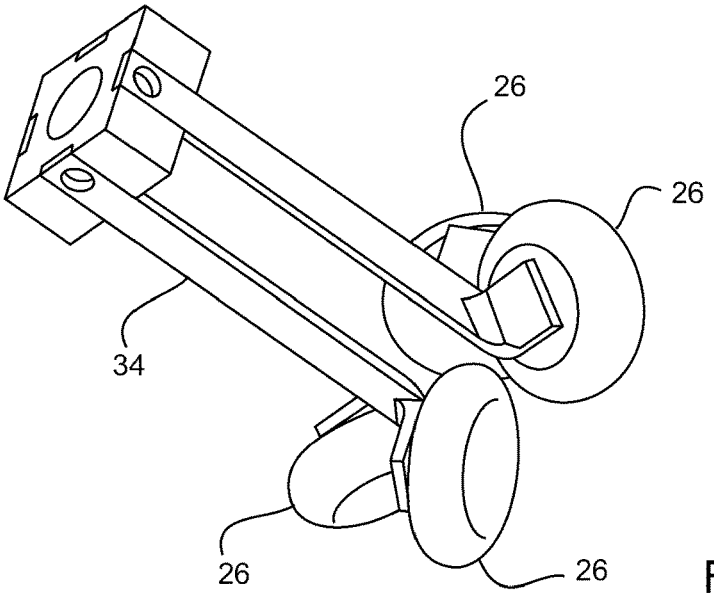
FIG. 4 shows a carrier with 'skewed' wheels/rollers for the sensing device deployment control apparatus according to the embodiment shown in FIGS. 1 to 3.

A number of embodiments of the present invention are proposed herein as alternative solutions to the problem(s) associated with deploying a sensing device downhole without connection to a deployment means at the surface.

Specific reference to a sensing device in the following examples and embodiments is not to be taken as limiting the present invention to deployment means and methods for a sensing device.

The scope of the present invention and embodiments thereof includes downhole sensing devices generally, including sensing devices, logging instruments and other downhole instruments, for obtaining data, information, samples and/or images from within a borehole.

First Form of the Present Invention

Reference is made to FIGS. 1 to 4.

One form of the sensing device deployment control apparatus 10 to deploy the sensing device, such as a sensing device, includes use of a hydraulic drag device 12. In the following embodiment, reference to a sensing device is to be taken to include reference to other sensing devices, such as sensing devices having one or more logging instruments, core oriention sensors, one or more gamma detector(s), gyroscope(s), accelerometer(s), pressure sensor(s), temperature sensor(s), vibration sensor(s), camera(s) and magnetometer(s), or combinations of two or more thereof, or any other sensor suitable to be deployed downhole within a borehole associated with a drilling operation.

Axial motion 14 of the apparatus down the drill string inner pipe (not shown) causes relative motion between two or more elements 16, 18. The first 16 being moveable (e.g. rotatable) relative to the drill pipe, and the second 18 being fixed relative to the drill pipe. Both elements are coupled by a damper device 20, such as a viscous coupling. In this manner and by such an apparatus, fall rate of the sensing device can be controlled via (e.g. viscous) damping with the terminal speed of the apparatus thus controlled to an acceptable level.

One of the challenges with such a mechanism is the tight space constraints within the pipe. The complete mechanism must fit within a pipe whose internal diameter, for RC drill strings, is typically 50 mm.

An embodiment of the present invention in this instance can include one or more of a device, system or method where the axial motion of the sensing device progressing down the borehole is used to generate rotary motion via use of an upper 16 and lower 18 body, interconnected with an axially located shaft 22.

By adopting axially aligned sprung friction wheels/rollers 24 on one body 18, and similar wheels/rollers 26 skewed relative to the axis 14 on the other body 16, will result in the skewed wheels prescribing a helix during downward motion whilst contacting the inner wall of the inner pipe, thereby imparting rotation of the mentioned interconnecting shaft 22 as the upper body/element 16 rotates relative to the lower body/element 18 and the fixed inner pipe.

Preferably the skewed wheels/rollers 26 are retained by a carrier 34 attached to the shaft 22 and/or to the upper body 16.

It will be appreciated that the skewed wheels/rollers arrangement and the axially aligned wheels/rollers arrangement can be transposed such that the lower body rotates relative to the upper body and fixed inner pipe. Thus, the shaft 22 would drive the drag device from below. In essence, the sensing device deployment apparatus can be inverted.

A series of discs/vanes 30 keyed to the axial shaft, and interspersed with mating discs/vanes 28 fixed to the lower body 18 are disposed in a fluid (oil) filled cavity 32 in said body, in the manner of a multi-plate hydraulic clutch pack.

Setting or controlling the clearance between adjacent discs/banes, in conjunction with selecting/controlling viscosity of the fluid, enables one to thereby control the drag produced by the apparatus.

Viscosity of most fluids is highly dependent upon its temperature. The majority of the drag device's potential energy during a fall will be converted to kinetic energy and this will in part be converted to heat within the fluid which in turn will be transferred to the body of the drag device. A significant fall distance and/or rate combined with a heavy sensing device will cause the fluid to heat substantially and thereby change its viscosity and thus alter the fall rate/speed. Consequently, heat dissipating measures can be provided, such as a heat sink an/or fluid circulating means to circulate and cool the fluid.

Such an arrangement may preferably be filled with liquid fluid (such as a hydraulic fluid or other natural or synthetic oil) with preferably no chambers containing gas as otherwise significant differential pressure may occur across the walls of the body and the necessary seals on the interconnecting shaft, leading to regular maintenance being required on the shaft seals and bearings.

Second Form of the Present Invention

Figure 5:
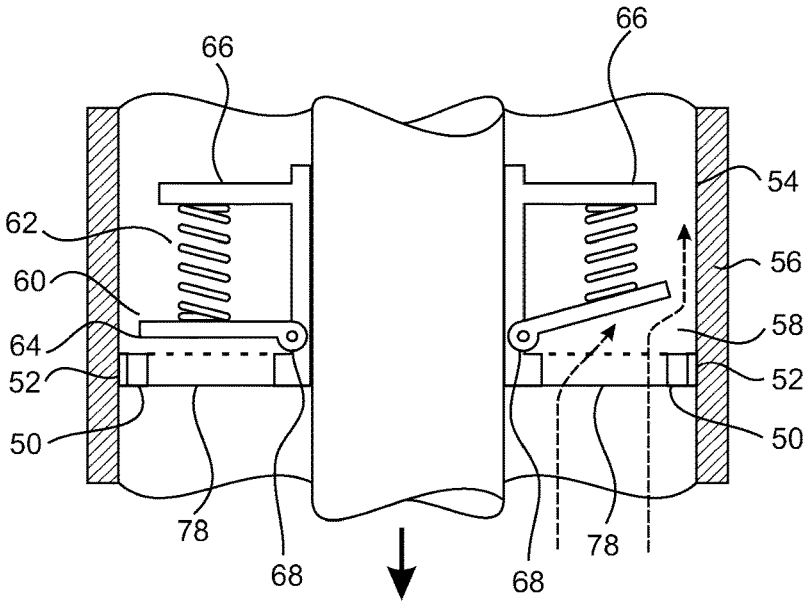
FIG. 5 shows an axial valve arrangement for a sensing device deployment control apparatus according to a further embodiment of the present invention.
Figure 6:
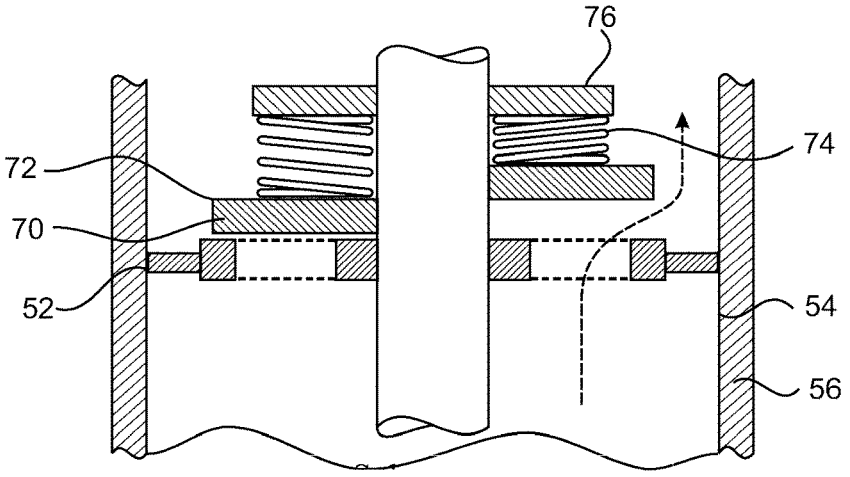
FIG. 6 shows an axial valve arrangement for a sensing device deployment control apparatus according to a further embodiment of the present invention.

Alternative embodiments of the present invention are shown in FIGS. 5 and 6.

FIGS. 5 and 6 show embodiments utilising aerodynamic drag to limit the speed of descent of the falling sensing device. In the following embodiment, reference to a sensing device is to be taken to include reference to other sensing devices, such as sensing devices having one or more logging instruments, core oriention sensors, one or more gamma detector(s), gyroscope(s), accelerometer(s), pressure sensor(s), temperature sensor(s), vibration sensor(s), camera(s) and magnetometer(s), or combinations of two or more thereof, or any other sensor suitable to be deployed downhole within a borehole associated with a drilling operation.

Alternative embodiments exist with this device, system and/or method, depending on whether the bottom of the borehole is open to atmosphere (as in the hole is dry) or closed, the closure being in the form of a water column being present between the outer pipes of the drill string and the bore hole.

In the first case, the rate of descent is controlled by the combination of resistance to the air flow from the bottom of the hole to the surface via the bore hole—string annulus, in combination with the flow past/through one or more protrusions or vanes on the falling sensing device. In this instance the falling apparatus and sensing device combination performs as a piston, forcing the air downwards, with some leakage past/through the vanes or around the 'piston' seal.

More reliable sensing device descent control is achieved by ensuring the bottom of the hammer/bit is effectively plugged. One proposed means of ensuring this is to drill a short distance, preferably with no rotation, and then stop, with the bit remaining in contact with the bottom of the hole. In this manner the cuttings and the base of the hole would act to plug the bottom end of the hammer. The result of this is to force the majority of the air displaced by the falling probe to bypass the sensing device via the clearance between the vanes and the internal diameter of the inner pipe.

The second mode of operation exists whereby the bottom of the hole is already effectively plugged by the presence of water, and by default the air displaced by the falling probe assembly must pass between the vanes and the pipe inner diameter.

The resulting arrangement, whereby the bottom of the hole is effectively blocked, enables a more controlled rate of descent of the sensing device to be achieved than would have been the case had the bottom been open. There are still several variables involved that will affect the descent rate, one of which is the variable wall diameter of the inner pipe. The inner diameter on a used string will generally be larger at the bottom of the hole, this being a direct result of the abrasive cuttings exiting the hammer and travelling upwards. Evidence from the field demonstrates the wear to be much higher at the bottom of the hole than at the top.

Also, unless deliberately cycled in an effort to produce more uniform wear and maximise drill string life (which many drillers do not undertake) the lower pipes will be used more frequently than the upper pipes, thereby exacerbating the difference in relative wear rate.

Hence, the gap between fixed diameter protrusion(s)/vane(s) and the inner pipe will increase as the mechanism approaches the bottom of the hole, resulting in less drag and a higher speed.

When attempting to control speed in this manner the drag is very sensitive to the gap present between the fixed diameter vanes and the inner pipe.

It is therefore desirable to incorporate compliance in the protrusion(s)/vane(s) so that the gap available for the flow of displaced air past/through them is controlled and not too dependent on the inner pipe internal diameter.

An arrangement that results in more constant drag is the use of one or more compliant protrusions/vanes sealing within the bore of the inner pipe, but which incorporate one or multiple apertures between their perimeter and inner diameter, the flow area of these apertures remaining relatively constant and independent of the pipe bore diameter.

A challenge with such a device, system or method for deployment of the sensing device is that, in an air column, the speed of descent will be well controlled; however; if there is water in the inner pipe the drag will change considerably when the water is encountered. This is due largely to the factor of ×100 difference between the viscosity of the gas and that of the (liquid) fluid. A result is that if the system is tuned for use in air the descent rate will be far too slow in water. Conversely, if the descent rate is set for operation in water it will be far too high in air.

Another problem will be the very high deceleration rate of the falling sensing device (e.g. survey probe) when it encounters the water column. Since the water is fully contained by the pipe walls and the bottom of the hole, and since water is relatively incompressible, there will be little cushioning of the impact.

This issue may be countered via utilisation of a damping device. For example, a damping device that protrudes from and in advance of the sensing device.

Such a device may incorporate one or both a mechanical and fluid damper. For example, a spring and a fluidic dashpot to controllably decrease the impact speed of the sensing device when the water is encountered.

Similarly, means may be provided that increases the aperture area between the flow controlling protrusion(s)/vane(s), increasing it many fold once the water is met. The spring/dashpot mechanism may be used as an actuator to increase the said aperture flow area.

The challenge of controlling the rate of descent of a falling sensing device (e.g. survey probe or instrument) to the bottom of the hole becomes significantly more difficult when two fluid media (both gas and liquid) are present within the system.

Axial valving arrangements can be utilised according to embodiments of the present invention.

As shown in FIG. 5, the sensing device deployment control apparatus 10 includes a protrusion, such as a flange or vane, 50 with a seal 52 contacting the inner wall 54 of the inner pipe 56. A gap 58 therefore exists between the sensing device and the pipe wall.

Valving 60 in the form of spring 62 loaded flaps 64 controls flow of air past/around the apparatus. The valve flaps 64 are pivoted at respective pivot axes 68. The springs are retained against extension portions 66.

In FIG. 5, the left side valving is shown closed, and the right side valving shown open, as examples of how the valving operates. In practice, most likely both sides would be either open or closed.

FIG. 6 shows an alternative embodiment of valving to control descent of the apparatus and thus of the sensing device. Instead of pivoted valve flaps shown in FIG. 5, the valving 70 is an annular plate valve 72 preloaded by a biasing means (such as a spring) 74.

As with FIG. 5, the left hand side is shown closed and the right hand side shown open. In practice, the entire annular plate valve is either open or closed. Extension portion 76 retains the biasing means.

In either arrangement in FIGS. 5 and 6, when the valving is open during descent of the sensing device, air flows through one or more apertures 78.

Third Form of the Present Invention

Facilitating deployment and/or function of the device, system and/or method of the present invention may be achieved by ensuring only one fluid medium is present in the inner pipe i.e. liquid or gas.

This may be achieved via (positive) pressurisation of the drill string, the purpose of which is to purge any liquid from the system and prevent re-entry.

There may be a significant hydrostatic water head that will need to be blocked in order to prevent the re-entry of the water. If so, this cannot be achieved with a permanently fitted check valve within the inner tube, as it would prevent the conveyance of the cutting to the surface.

Also, any valve placed thus would wear at a very high rate due to the high velocity abrasive cuttings travelling though it whenever drilling took place.

Note that an (RC) hammer drill does have a check valve however this acts on the annulus through which air is delivered, and its purpose is to prevent back-flow through the hammer motor, and it does not function on the return circuit that convey cuttings to the surface through the inner tube, and hence use of this valve is not an option.

One or more embodiments of the present invention therefore utilises at least one one-way valve that is propelled to the bottom of the inner tube during the purging operation.

This may incorporate a toggle mechanism such that when in position one or more latches lock it in the desired location and prevent ingress of water when the pressure within the string was vented.

Figure 8A:
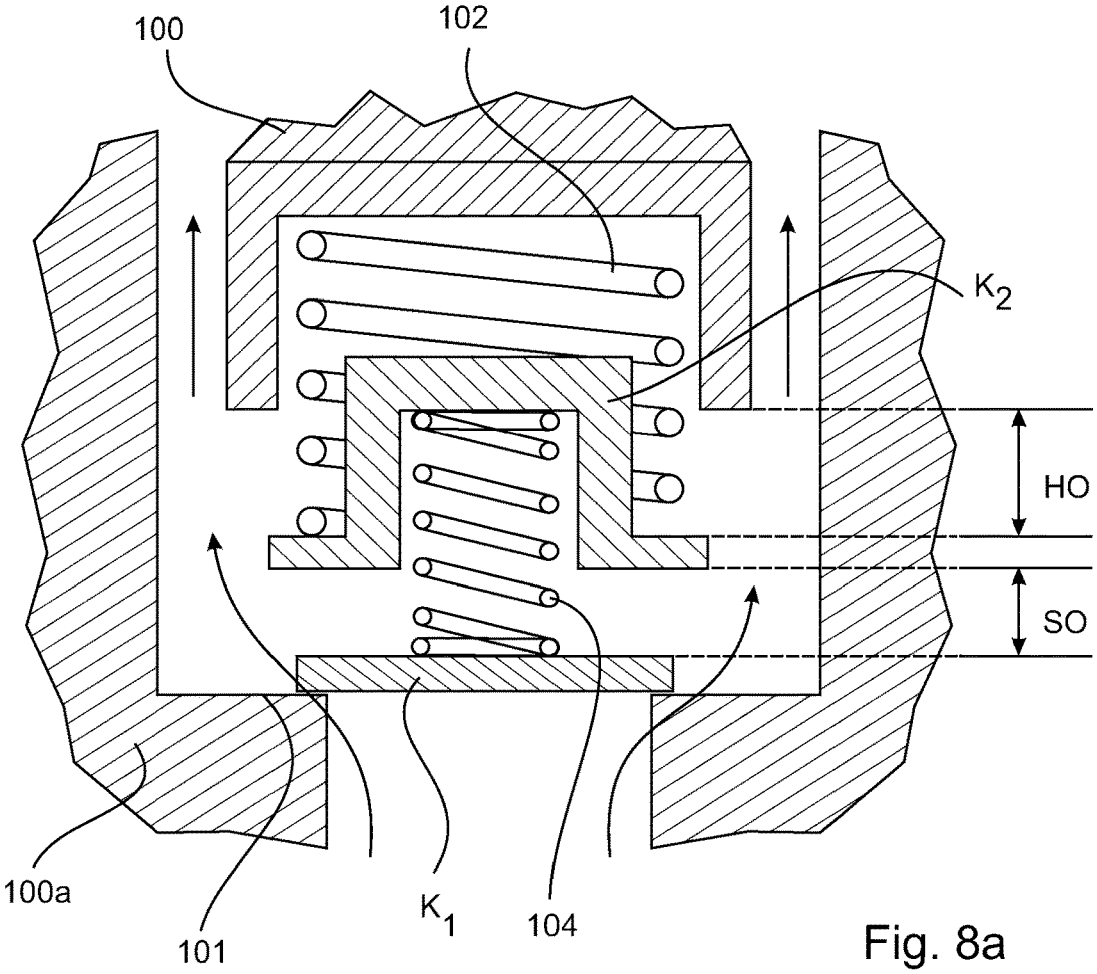
FIG. 8 shows a dual rate valve device applicable to one or more embodiments of the present invention.

FIG. 8*a* shows a dual rate valve 100 to control descent of the sensing device deployment apparatus and thus descent of the sensing device.

As shown in FIG. 8*a*, the dual rate valve 100 has a housing 100*a* containing a first spring biased valve $K_1$ operating on a valve seat 101, and a second spring biased valve $K_2$. Due to higher spring force from spring 102 of valve K2, spring 102 opens when forced by the higher pressure differential ΔP due to water backflow.

Such a dual rate valve arrangement of check valve enables flow of air past the valving (valve $K_1$) with low differential pressure when the valve is descending under gravity. The valving also enables back flow of water when the drill pipe is vented on the topside past the sensing device that is locked in position.

During descent, the stiffness of softer spring 104 of valving $K_1$ controls the pressure differential ΔP across the valve and hence controls the descent speed.

Thus, valving $K_2$ provides a 'hard' opening (HO) and valve $K_1$ provides a 'soft' opening (SO), as marked on FIG. 8*a*.

Figure 8B:
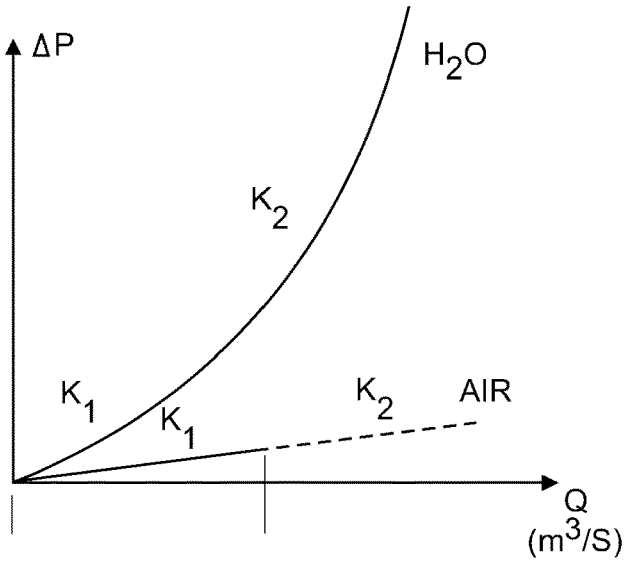

As shown in graph FIG. 8*b* of pressure differential ΔP vs volume flow per second Q ($m^3s^{-1}$), valve $K_1$ opens for air to flow past the valving e.g. when purging the inner pipe, and valve $K_2$ opens when higher pressure water passes through the valving during purging.

A challenge with this is that if problems are encountered down the borehole, such as when wanting to extract the drill string, one may need to revert to operating the hammer. Therefore, a means of removing or opening the check valve may be required. A wireline/winch may be provided to facilitate removal of the check valve(s).

A means of preventing the inflow of water though the bit sludge holes into the sample tube and up the inner string is to maintain the pressure within the inner tube at a value greater than the hydrostatic pressure in the ground formation at the bottom of the hammer. This may be achieved with the controls available at the surface on the drill rig, e.g. by operating the pneumatic circuit in the 'blow-down' mode. Such an approach enables the hammer drill to be operated simply by directing the air in the normal manner down the annulus when and if required, and negates the need for extra check valves within the system.

This approach then requires a means of deploying the sensing device such that it progresses down the inner pipe mainly via the action of gravity to the desired location behind (uphole) of the hammer down the hole, whilst the inner drill pipes are pressurised to some value above ambient.

The pressures involved may be too high to allow an operator to drop the sensing device after gaining access to the inner pipe by disconnecting the surface level rod string from the rig. In such a situation, the differential pressure would force liquid back into the inner pipe, and the up flow of both air and water would prevent the sensing device descending in the desired manner.

This issue may be overcome by insertion of a sub that allows the sensing device to be loaded into the top of the drill string and held at the surface whilst the drill string is pressurised and the fluid purged from the string. Once the unwanted water had been eliminated the string would remain at pressure, and a means may then be actuated in order to release the sensing device such that it could free fall down the compressed air column within the inner pipe.

When the water has been purged from the hammer, one would expect to see a decrease in the pressure at the top of the hole, due to the lifting of the surplus water from the annulus between hole and drill string, and also due to aeration of the water column, this effectively reducing the specific gravity of the column. Knowing the delivery rate of compressed air to the inner pipe system one could also determine the period of time required to displace a known water column from the system. Hence there is/are a multiplicity of means of determining when the release mechanism should be actuated and thereby the sensing device deployed.

When the sensing device includes fragile electronic components and sensors, it is necessary to prevent high speed impact of the sensing device when it reaches its final location at the bottom of the hole. To this end, a landing device is proposed that controllably decelerates the device from its terminal free fall velocity within the pipe to zero. For example, a dashpot may include a spring and damper mechanism fitted to the lower end of the sensing device. These are tuned to suit the mass and velocity of the sensing device and provide a heavily damped motion upon impact.

Additionally positive location may need to be established once the sensing device is positioned at or close to the hole terminus. The need for this arises the drill string must be depressurised when removing pipes at the surface. If this is done without latching the sensing device in place, the water pressure at the bottom of the hole could uncontrollably lift the sensing device off the back of the hammer and convey it upwards within the inner pipe. This will lead to spasmodic speed as the sensing device will not be travelling upwards at the same speed as the drill string, and varying time spent at various depth intervals, thereby reducing measurement accuracy and resolution.

In case the sensing device requires removal from the borehole prior to extracting the complete drill string, such as should the string become bogged and the hammer needs firing, a means of retrieving the sensing device is necessary. In this case an overshot style device may be used in conjunction with the latching mechanism.

The latching system may require a shoulder against which to locate within the inner pipe. This may be manufactured from a very hard wear resistant material, such as tungsten carbide (WC), and that this element may be replaceable.

The shoulder against which the latch would engage for the RC application preferably may include the upper wall of a groove manufactured within the inner wall of the inner conduit (pipe). This requirement arises due to the operating mode of RC drilling, whereby abrasive cuttings (with high silica content) are pneumatically conveyed to the surface. Typically in the lower extremities of the RC drill string where the air is still expanding the speed is of the order of 30 m/s.

A groove, which provides at least one projection, such as one or more shoulders, disposed away from the centre of the conduit may be provided. Alternatively, an inwards jutting land disposed toward the conduit centre may be provided. The former projection arrangement is preferred because it minimises its exposure to the abrasive cuttings, and thereby will ensure the greatest wear life.

It is important for reliable latching that this shoulder arrangement remain in good condition, and not become worn and rounded, as otherwise the latches may not lock correctly in position. An inwards projecting land would face the full brunt of the cuttings and thereby suffer high wear and a short service life.

Additionally, such a land would restrict the cuttings flow and reduce system efficiency. As well, it presence would disrupt the flow and create eddies downstream, these in turn biasing the cuttings flow toward the conduit walls and locally exacerbating the wear.

A groove/latch shoulder arrangement may be located within the lead inner pipe, and may be incorporated in the top of the hammer sub, or may be sandwiched between the two.

An alternative is to a special sub at the interface between the top of the lead pipe, which for RC is normally 3~4 metres in length rather than the standard 6 metres, and the adjacent pipe located above it.

This provision of the sub has minimal impact on the drill string and sensing device. Such a sub preferably has an effective length within the string of 200~300 mm and as such does not add significantly to the length of the bottom hole assembly (BHA). This works well in conjunction with the short lead rod, the main purpose of the latter being to enable the fitment of the hammer (typically 1.2 metres in length) without requiring excessive mast head travel, some drill rigs being limited in this regard.

The latch mechanism itself may be incorporated with the body of the device containing the sealing vanes, or it may be separate if a modular approach is desired.

A means of coupling the two together may be required, and in turn these may be coupled with the sensing device.

Similarly, the cushion mechanism must be coupled to the lower (e.g. front when descending) end of the sensing device.

The latch mechanism may rely on one or more of a series of links, a cam, or other means of toggling the latches and locking them in position, or combinations of two or more thereof.

The latch engaging dogs may be energised via a biasing and/or resilient means (such as a spring mechanism or other mechanism) to hold them against the inner pipe wall and force them into the groove containing the shoulder against which they lock once the assembly reaches its final resting location.

The outside face of the latch dogs may possess a curved face that will match the profile (radius of curvature) of the groove in which they lock. Such a face may be hardened in order to minimise the wear incurred during deployment.

Said groove may be sufficiently wide as to accommodate the dogs such that they provide contact with the full width of the shoulder against which they locate.

At the upper end of an RC hammer located within the top sub there is preferably provided at least one adaptor tube that conveys cuttings from the upper end of the sample tube to the lower end of the lead inner pipe. An upper end of a said adapter tube fits within the lower end of the inner pipe. The inner pipe is typically 50 mm in diameter, whereas the adaptor tube has an internal chamfer where the diameter decreases to match that of the sample tube. Typically sample tube diameters for mainstream RC applications vary from 3040 mm. The nose of the landing device is therefore designed to impact and reside proximal to the interface between the adaptor tube and the lower lead inner tube of the drill string.

Once latched in position, the string may be depressurised, this leading to water from within the hole entering back through the bit and sample tube and into the region where the probe is locked. The water pressure will act upon the vanes used to restrict the descent rate through the air column with a differential of hundreds of psi/decades of bars and pass through the small aperture present. Since the viscosity of water is 50 times greater than that of air, considerable force will be exerted by the inflowing water to the inner pipe with a high likelihood of damage to the to the controlled descent mechanism.

In order to alleviate this situation, valving may be provided to enable free flow of the water upwards past the in hole sensing device/deployment mechanism. This valving would have considerably greater flow area that the aperture controlling the descent.

Such valving may be preloaded such that the pressure required to open it was significantly higher than that required to allow the assembly to free fall. In this manner, it is analogous to a zener diode in an electrical circuit. The water circuit valving would function in addition to and in parallel with that of the air. The water back flow control means just described may be separate to or common with that of the air.

Figure 7:
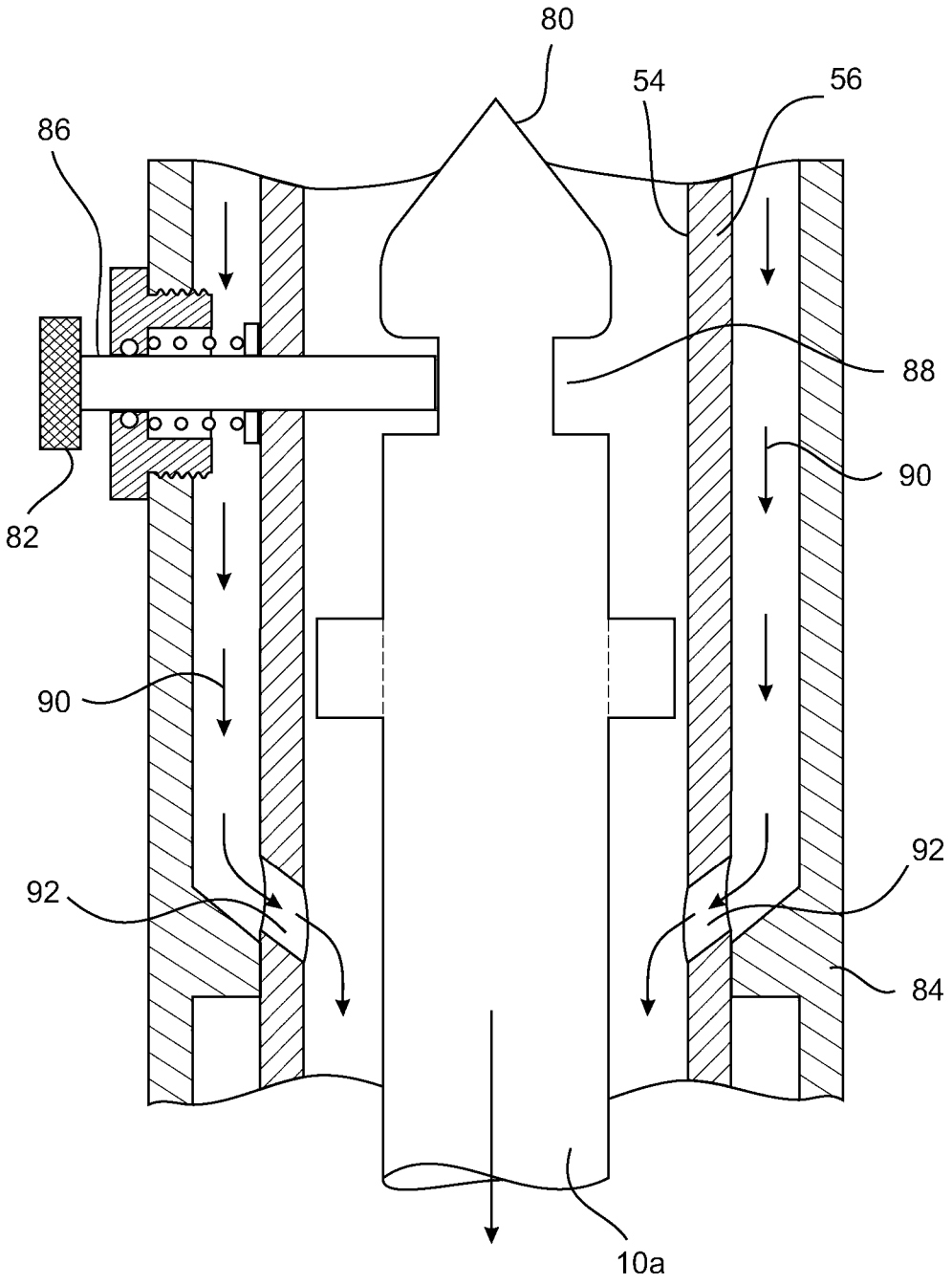
FIG. 7 shows a pressurised drill string, blow down valve, deployment sub with retrieval arrangement according to a further embodiment of the present invention.

As shown in FIG. 7, the sensing device 10*a* has a spearhead type retrieval means 80 for retrieval of the sensing device via wireline (not shown).

A latching means 82 provided in the wall of the outer pipe 84 includes a latch 86 that engages into a recess 88 of the sensing device or backend assembly thereof (such as just under the spearhead 80). Pressurised airflow 90 enters the inner pipe 54 via holes 92.

Preferably there are two latches in order to prevent accidental release i.e. two hands are required to release the sensing device.

Fourth Form of the Present Invention

Figure 9:
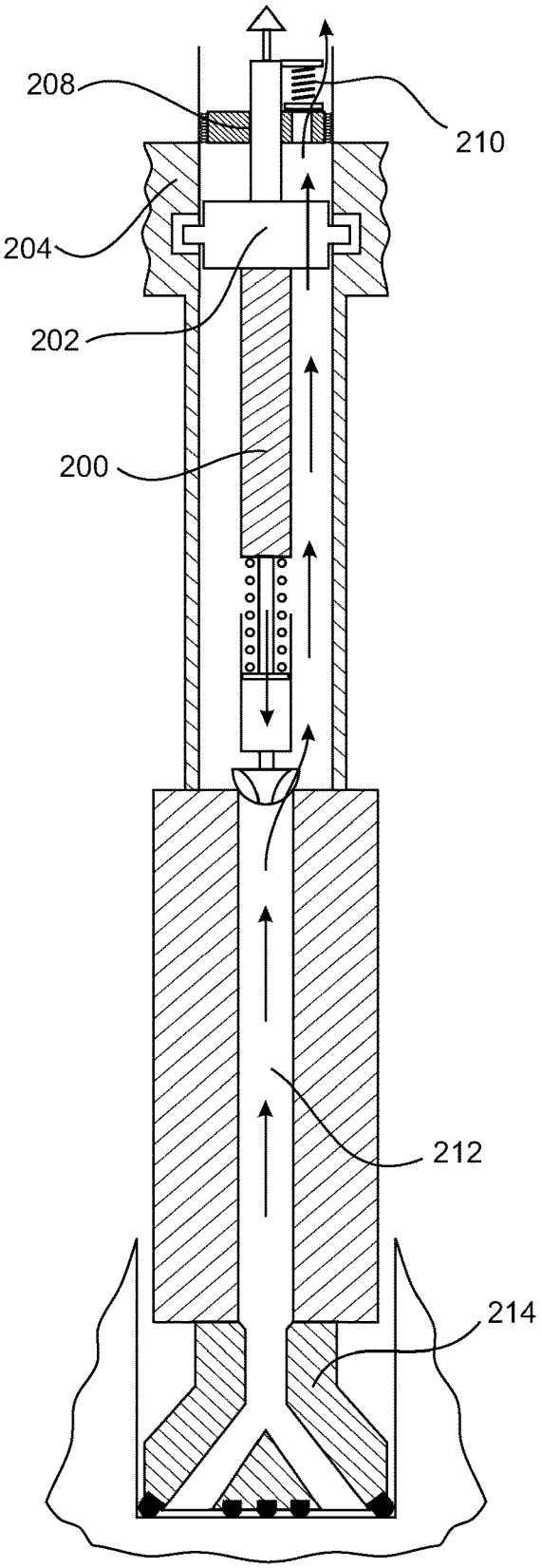
FIG. 9 shows a pump down sensing device deployment apparatus with landing and latch devices above an RC hammer drill, according to a further embodiment of the present invention.
Figure 10:
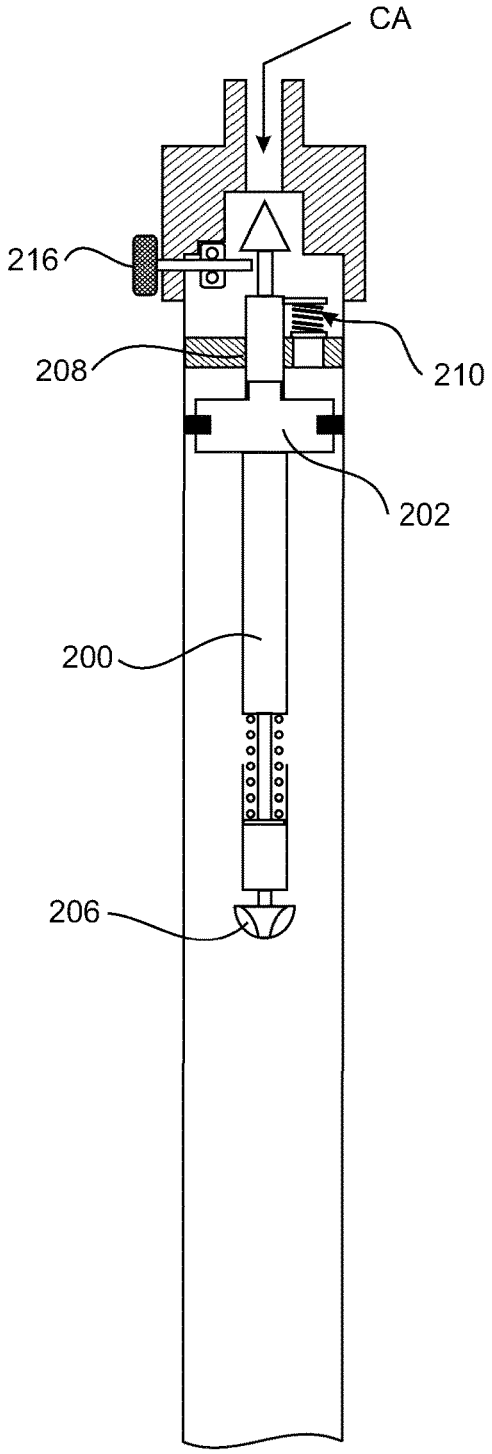
FIG. 10 shows a device for releasing a sensing device for deployment downhole utilising the pump down sensing device deployment apparatus of FIG. 9, according to a further embodiment of the present invention.

FIGS. 9 and 10 provide examples of one or more pump down arrangements of the sensing device deployment apparatus and sensing device.

FIG. 9 shows the apparatus and device in a deployed position with the latch mechanism latched into a latch recess or groove.

FIG. 10 shows the arrangement and device ready for deployment with a release pin 216 ready to release. Outer tube is omitted for clarity.

A complete seal is provided such that the sensing device 200, latch 202 and/or seal 208 act as a piston, with practically no leakage being present past the seal.

As shown in FIG. 9, latch mechanism 202 engages with a latch groove or recess arrangement 204 downhole to retain the probe in position and allow the spring 205 to damp landing of the landing nose 206 to the seat and to allow the landing nose to lift under pressure of fluid rising up from the bit 214 through the central bore 212.

From FIG. 10, once the release pin 216 is released, the probe is pumped down the borehole by compressed air CA until the latch latches in position shown in FIG. 9.

A piston seal head 208 is provided, incorporating a dual rate valve 210. As shown in FIG. 9 after deployment, fluid flow up through the central tube 212 flows past the landing nose 206, past the probe 200, past the vane with latch mechanism 202, and lifts one or both of the valves in the dual valve arrangement 210.

If the bottom of the hole is predominantly, but not completely sealed as aforementioned i.e. no compression lock, it is possible to use the compressed air CA above the sensing device to pump the sensing device to the bottom of the hole, in a manner analogous to that used to deploy a core barrel assembly during the diamond coring method of drilling. This will enable deployment for holes of any inclination, even up holes, as gravity is no longer being relied upon to provide the necessary motivation.

With such a device, system or method, a flow indicating device may be installed within the drill string to indicate the travel velocity of the compressed air (and sensing device) down the hole.

Knowing the speed and the distance to be travelled, the time necessary to reach the end of the string may the determined. This, thereby, enables the operator to reduce the speed of the sensing device just prior to it reaching the end of the hole, thus permitting the minimisation of the impact velocity. A corollary to this is that the total traverse time of the sensing device will be minimised, thereby maximising the efficiency of the process.

Monitoring the air speed and/or the top of the hole air pressure enables the operator to determine when the bottom of the hole has been reached, as the flow will decrease and the pressure will increase. This is analogous to the deployment of a core barrel assembly with the diamond coring method, although in the former case a compressible medium is being used whereas for the latter the fluid is essentially incompressible.

With reference to the aforementioned general descriptions of alternative forms of the present invention, one or more preferred embodiments of the present invention provides the following:

Free Fall System—(e.g. If the Bore Hole Is Dry)

A mechanism with a compliant seal that ensures intimate contact with the inner drill pipe wall is maintained, possessing either one or multiple apertures through which air displaced by the falling sensing device may flow.

The aperture area may be adjustable prior to deployment of the sensing device in order to suit the total mass of the sensing device and/or to match the angle of inclination of the hole, as both these parameters determine the amount of drag that is required to be produced in order to limit the descent speed to acceptable values.

Alternatively, the aperture flow area may be actively adjusted during descent by an adjustment mechanism. For example, the adjustment mechanism may effectively sense the speed of air passing through it, thereby automatically controlling the speed of descent under a range of conditions and eliminating/minimising the need for operator adjustment.

Such a process may be achieved, for example, via use of a spring energised valve that ensures a constant differential pressure is maintained across the sealing mechanism.

The active device, system or method with feedback is preferred as it will adjust to compensate for different mass probes, different hole angles, and varying drag within the hole arising from the presence of oil and/or cuttings adhering to the inside of the pipe wall. These deposits will tend to be wiped by the seal during its passage and may build up, increasing drag.

The seal may incorporate means for preventing excessive accumulation of such by either deflecting over the deposit, or passing it through the aperture(s).

A device may be provided at the lower end of the sensing device that functions as a cushion against the impact forces incurred when the falling sensing device reaches the stop at the bottom of the hole. Such a device may include a biasing means, such as one or more springs, a dashpot system or similar functioning means, the purpose of which is to control the rate of deceleration upon impact to acceptable level whilst also absorbing the majority of the kinetic energy to prevent damage to the sensing device when landing.

A retrieval device similar to an overshot (such as used when diamond coring) may also be incorporated so that the sensing device may be removed if required, prior to the complete string being extracted from the hole.

Pump-In System—e.g. for Wet Bore Holes:

One or more preferred arrangements of the present invention when deploying the sensing device in boreholes containing water or other fluids is the 'pump-in' arrangement, whereby a seal is created around the sensing device so that it behaves as a piston within the drill pipe. Compressed air behind the sensing device is then used to motivate the 'piston' down the pipe, overcoming any resistance met.

As detailed above, this method preferably requires the bottom of the inner pipe to be effectively plugged or at least significantly restricted in order to ensure there is a reasonably constant resistance against which to work, thereby providing controllability of the descent rate for the sensing device.

This approach also requires the entire inner pipe to remain pressurised in order to prevent re-entry of water to the bottom of the hole, thus ensuring only one media (with a set viscosity) is present in the hole.

A means of holding the probe at the top of the hole and releasing when required whilst at the same time maintaining the string at an elevated pressure must be used. Such a sub is described above.

Controlling the rate of flow of air above the piston provides the operator with a means of controlling the speed of the 'piston' sensing device. This system also enables deployment in upward holes, and therefore would be useful for underground application when the RC method of drilling is used.

One or more embodiments may include a means of locking or latching the sensing device in place when it has reached its downhole destination. For example, a release pin operated latch arrangement, as shown in FIG. 10. This enables physically restraining/locking/latching the sensing device downhole when fluid (air, water, air and water) is purged from the borehole i.e. the sensing device is prevented from being pushed back up the borehole by pressure of the purging fluid.

A one-way flow means to allow backflow of water past the sensing device and associated deployment system is required as a means of minimising forces and differential pressure on the mechanism once the pressurised inner pipe is vented to atmosphere.

The invention claimed is:

1. A sensing device deployment control apparatus, the deployment control apparatus connected to a sensing device, the deployment control apparatus including at least one drag device comprising a valve device configured to control rate of fluid flow through the valve device to control the speed of the sensing device progressing within a borehole associated with a drilling operation, wherein the valve device is internal of the deployment control apparatus and the valve device is configured to change from a first flow area for fluid flow through the valve device to a second flow area for flow of a higher density fluid through the valve device, the second flow area being greater than the first flow area, wherein the valve device is configured to operate to allow two different flow rates, each flow rate for a different viscosity fluid to flow through the valve device.

2. The deployment control apparatus of claim 1, wherein the sensing device is not attached to a wireline or pipe during downward deployment within the borehole.

3. The deployment control apparatus of claim 1, wherein the deployment control apparatus is attached to the sensing device.

4. The deployment control apparatus of claim 1, wherein the deployment control apparatus forms part of the sensing device.

5. A sensing device deployment control system, including the sensing device deployment control apparatus of claim 1, the sensing device and at least one of: a blow down sub, a head valve, a landing device provided at a landing location within an inner pipe to prevent impact damage to the sensing device.

6. The sensing device deployment control system of claim 5, including retaining means to ensure correct positioning of the sensing device within the borehole.

7. The sensing device deployment control system of claim 6, the retaining means including latching means including at least one link or at least one cam, or a combination of at least one link and at least one cam.

8. The sensing device deployment control system of claim 6, the retaining means including at least one shoulder outwardly disposed away from flow within the inner pipe.

9. The sensing device deployment control system of claim 8, including a sub between a lead rod and a next uphole rod, the sub including the at least one shoulder.

10. The sensing device deployment control system of claim 5, further including retrieval means to recover the deployed sensing device from downhole.

11. The sensing device deployment control system of claim 5, including at least one one-way valve positioned downhole prior to deployment of the sensing device, the at least one one-way valve allowing water to be expelled from the inner pipe and preventing water entering the inner pipe.

12. The sensing device deployment control system of claim 11, the at least one one-way valve propelled downhole in advance of the sensing device being deployed.

13. The sensing device deployment control system of claim 11, including a one-way valve landing device to receive the at least one one-way valve at a required downhole position.

14. The sensing device deployment control system of claim 5, further including a damper device as a cushion against impact force incurred when the descending sensing device reaches the stop at the bottom of the hole.

15. The sensing device deployment control system of claim 14, wherein the damper device includes a biasing means, such as one or more springs or a dashpot system.

16. The deployment control apparatus of claim 1, wherein one of the fluids is a gas and a second said fluid is a liquid.

17. The deployment control apparatus of claim 16, wherein the gas contains air and the liquid contains water.

18. The deployment control apparatus of claim 1, wherein the valve device includes a dual rate valve device.

19. The deployment control apparatus of claim 18, wherein the dual rate valve device includes a first spring biased valve operating on a valve seat and a second spring biased valve.

20. The deployment control apparatus of claim 19, wherein the dual rate valve device enables flow of air past the first spring biased valve when the sensing device is descending under gravity.

21. The deployment control apparatus of claim 20, wherein, during descent into the borehole, a stiffness of a spring of the first spring biased valve controls pressure differential $\Delta P$ across the first spring biased valve and hence controls the descent speed of the sensing device.

22. The deployment control apparatus of claim 18, wherein the dual rate valve device enables flow of air past a first valve when the sensing device is descending under gravity.

23. The deployment control apparatus of claim 18, wherein, during descent into the borehole, a stiffness of a spring of a first valve of the dual rate valve device controls pressure differential $\Delta P$ across the first valve and hence controls the descent speed of the sensing device.

24. The deployment control apparatus of claim 1, wherein the valve device includes a dual rate valve device including a first valve including a first aperture and a second valve including a second aperture, wherein the first aperture provides the first flow area and the second aperture provides the second flow area being greater than the first flow area, and wherein the first valve opens for air to flow past the first aperture and the second valve opens for water to pass through the second aperture when water passes through the valve device.

25. The deployment control apparatus of claim 1, wherein the valve device includes an aperture of a first valve allowing air to flow through the valve device during descent of the sensing device in air and a second valve having an aperture of greater flow area than the aperture of the first valve device for descent of the sensing device in water in the borehole.

26. The deployment control apparatus of claim 1, wherein the valve device includes preloaded valving such that a pressure required to open the preloaded valving is significantly higher than a pressure required to allow the sensing device to free fall in the borehole.

27. The deployment control apparatus of claim 26, wherein the preloaded valving operates in parallel with air flow control valving through the valve device.

28. The deployment control apparatus of claim 1, wherein the valve device enables back flow of water when a drill pipe containing the deployment control device is vented on a topside past the sensing device that is locked in position in the borehole.

29. The deployment control apparatus of claim 1, wherein the valve device changes from allowing a first flow rate for gas therethrough to a higher flow rate for allowing liquid therethrough.

30. A sensing device deployment control apparatus, the deployment control apparatus connected to a sensing device, the deployment control apparatus including at least one drag device comprising a valve device configured to control rate of fluid flow through the valve device to control the speed of the sensing device progressing within a borehole associated with a drilling operation, wherein the valve device is internal of the deployment control apparatus and wherein the valve device includes a dual rate valve device configured to change from a first flow area for fluid flow through the valve device to a second flow area for flow of a higher density fluid through the valve device, the second flow area being greater than the first flow area.

31. A sensing device deployment control apparatus, the deployment control apparatus connected to a sensing device, the deployment control apparatus including at least one drag device comprising a valve device configured to control rate of fluid flow through the valve device to control the speed of the sensing device progressing within a borehole associated with a drilling operation, wherein the valve device is internal of the deployment control apparatus and the valve device is configured to change from a first flow area for fluid flow through the valve device to a second flow area for flow of a higher density fluid through the valve device, the second flow area being greater than the first flow area, wherein the valve device includes preloaded valving such that a pressure required to open the preloaded valving is significantly higher than a pressure required to allow the sensing device to free fall in the borehole.

* * * * *